US005171006A

United States Patent [19]

Naito

[11] Patent Number: 5,171,006

[45] Date of Patent: Dec. 15, 1992

[54] SHEET MATERIAL FEEDING DEVICE

[75] Inventor: Hisatsugu Naito, Yokohama, Japan

[73] Assignee: Canon Kabushiki Kaisha, Tokyo, Japan

[21] Appl. No.: 875,219

[22] Filed: Apr. 28, 1992

Related U.S. Application Data

[63] Continuation of Ser. No. 803,908, Dec. 9, 1991, abandoned, which is a continuation of Ser. No. 501,881, Mar. 30, 1990, abandoned.

[30] Foreign Application Priority Data

Apr. 3, 1989 [JP] Japan ..... 1-37991

[51] Int. Cl.[5] ..... B65H 3/06

[52] U.S. Cl. ..... 271/9; 271/242; 271/245; 271/902; 400/629

[58] Field of Search ..... 271/9, 242, 245, 246, 271/902; 400/629

[56] References Cited

U.S. PATENT DOCUMENTS

| | | | |
|---|---|---|---|
| 3,963,339 | 6/1976 | Taylor | 271/9 |
| 4,025,187 | 5/1977 | Taylor et al. | 355/14 |
| 4,223,886 | 9/1980 | Vogt | 271/902 X |
| 4,565,462 | 1/1986 | Yamamoto et al. | 400/625 |
| 4,913,416 | 4/1990 | Murata | 271/902 X |

FOREIGN PATENT DOCUMENTS

| | | |
|---|---|---|
| 60-204566 | 10/1985 | Japan . |
| 61-148081 | 7/1986 | Japan . |

*Primary Examiner*—Richard A. Schacher

*Attorney, Agent, or Firm*—Fitzpatrick, Cella, Harper & Scinto

[57] ABSTRACT

A sheet material feeding device includes a first conveying path for feeding sheet material, a second conveying path for feeding the sheet material and which joins the first conveying path, an anchoring unit for anchoring and bending the leading end of the sheet material fed through the first conveying path or the second conveying path, and a guide member provided at the joining point of the first conveying path and the second conveying path for allowing the sheet material fed from an upstream side through the first conveying path to pass the joining point and for preventing the sheet material fed from a downstream side through the first conveying path from entering an upstream side from the joining point. The guide member presses a curved portion of the sheet material formed by the leading end of the sheet material fed through the first conveying path anchored by the anchoring unit in a direction to flatten that portion.

19 Claims, 8 Drawing Sheets

AUTOMATIC PAPER-FEEDING OPERATION AT TYPEWRITER MODE (NOT TEXT PRINTING) WHEN USING CSF

SHEET MATERIAL FEEDING DEVICE

This application is a continuation of application Ser. No. 07/803,908 filed Dec. 9, 1991, now abandoned, which is a continuation of application Ser. No. 07/501,881, filed Mar. 30, 1990, now abandoned.

BACKGROUND OF THE INVENTION

1. Field of the Invention

This invention relates to a sheet material feeding device for feeding sheets of material, such as single slips, cut sheets or the like, one by one to a recording apparatus.

2. Description of the Related Art

Usually, in this kind of sheet material feeding device, the top sheet of recording paper set within a hopper is fed to the side of a platen in a recording apparatus by a feed roller, and is once stopped in a somewhat curved state while contacting the platen. The platen is then rotated to move the sheet to a position at which printing is started.

The sheet is once stopped in a somewhat curved state while contacting the platen in order to prevent the sheet from being inserted in an inclined state when the platen is rotated. The sheet is made parallel to the platen utilizing the resistive force (stiffness) of the sheet against the bending force.

Such a technique is described, for example, in Japanese Patent Public Disclosure (Kokai) No. 60-204566 (1985).

In the sheet feeding device as described above, the sheet of recording paper is made parallel to the platen utilizing the stiffness of the sheet. The stiffness of the sheet changes, however, due to temperature, humidity and the like at the moment of use. Hence, the sheet is not always inserted in a state parallel to the platen, but there is the possibility that the sheet is inserted in an inclined state.

Furthermore, the force required to push the sheet to the side of the platen and feed roller so that the sheet is easily caught when the platen rotates also utilizes the stiffness of the sheet. However, since the stiffness of the sheet is not constant due to the same reasons as described above, the sheet is not always favorably caught.

In order to solve such problems, a technique has been disclosed in U.S. Pat. No. 4,025,187 in which, by providing a member for pressing a curved portion of a sheet, the front end of which contacts a registration roller in a direction to flatten the curved portion, the front end of the sheet is securely contacted with a nip member of the registration roller to remove the inclination of the front end of the sheet.

Furthermore, when a printing operation is performed after reversing the sheet, the sheet is reversed after it has been fed immediately before being discharged and is returned to a manual insertion port, because it is troublesome if the sheet returns to the side of the feed roller. This approach has the following disadvantage.

That is, in order to return the reversed sheet to the manual insertion port separated from sheets of the recording paper at the side of the feed roller, a skirt made of an elastic material, such as a film or the like, is provided on the path for the sheets. However, since the skirt is, for example, easily broken or bent, there is the possibility that the sheet is not securely returned to the manual insertion port.

Such a technique has been disclosed in U.S. Pat. No. 4,565,462 or in Japanese Patent Public Disclosure (Kokai) No. 61-148081 (1986).

SUMMARY OF THE INVENTION

It is an object of the present invention to solve the problems in the conventional techniques as described above.

It is another object of the present invention to provide a sheet material feeding device capable of securely inserting a sheet material into a platen without inclination, favorably catching the sheet material in the platen, and securely returning the sheet material to a manual insertion port or the like, even when a recording operation is performed, for example, by reversing the sheet material, only be adding a simple structure.

DETAILED DESCRIPTION OF THE PREFERRED EMBODIMENTS

An embodiment of the present invention will now be explained with reference to the drawings.

FIGS. 1 through 4 show a first embodiment of the present invention.

First, an outline of the entire recording apparatus will be explained with reference to FIG. 1.

Figure 1:
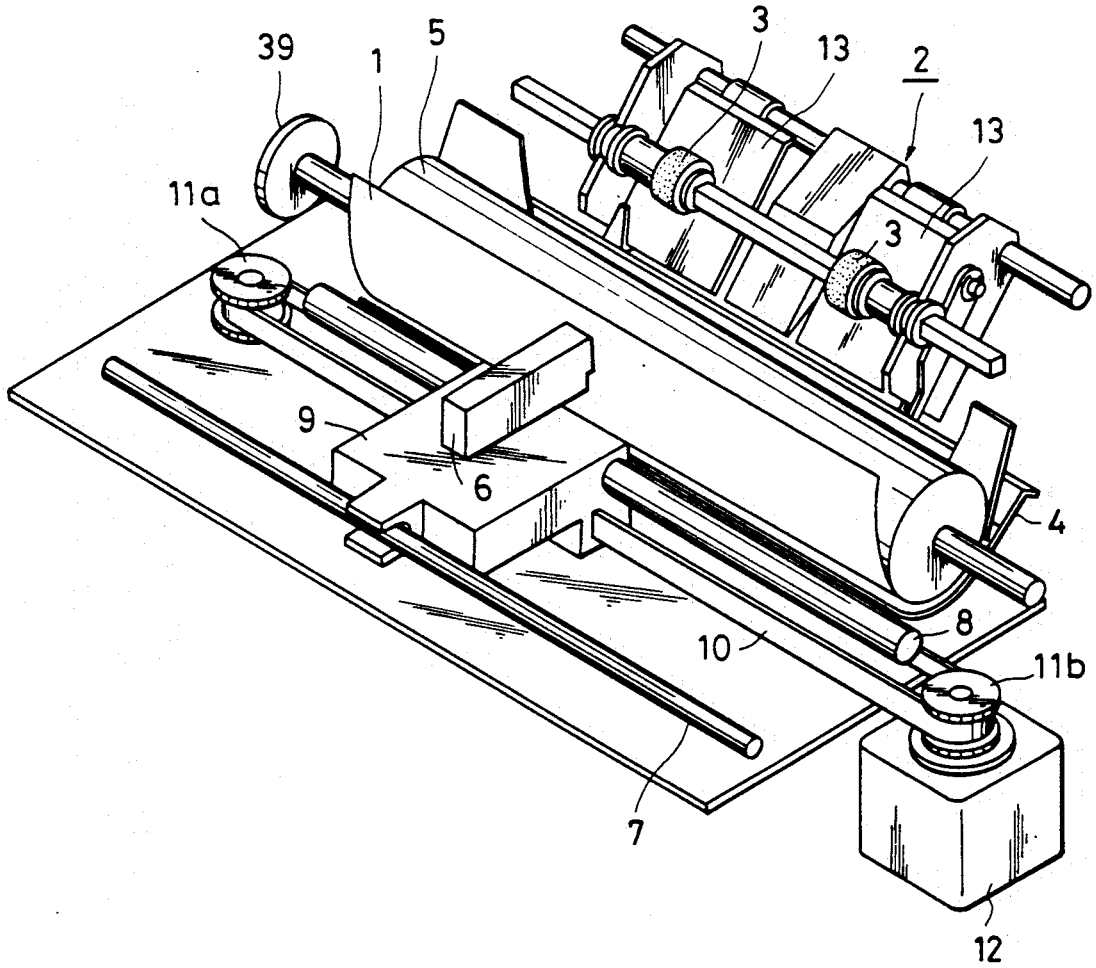
FIG. 1 is a perspective view showing a recording material, omitting a part thereof, which mounts a sheet material feeding device according to a first embodiment of the present invention.

In FIG. 1, a sheet material (a single slip) 1 previously cut in a predetermined size, such as recording paper, a plastic sheet or the like, is intermittently fed into the recording apparatus by a feed roller 3 in a sheet material feeding device 2.

The sheet material 1 is then fed between a paper pan 4 and a platen 5 guided by the paper pan 4 which is a guide member for guiding and supporting the sheet material 1, and is rolled around the platen 5. An ink-jet-type recording head 6 is provided facing the platen 5.

The recording head 6 is mounted on a carriage 9 reciprocating in the right and left directions in FIG. 1 along guide shafts 7 and 8 provided parallel to the platen 5.

The carriage 9 is connected to a motor 12 for moving the carriage via pulleys 11*a* and 11*b* between which a timing belt 10 is stretched, and is moved along the guide shafts 7 and 8 by the motor 12.

Figure 3:
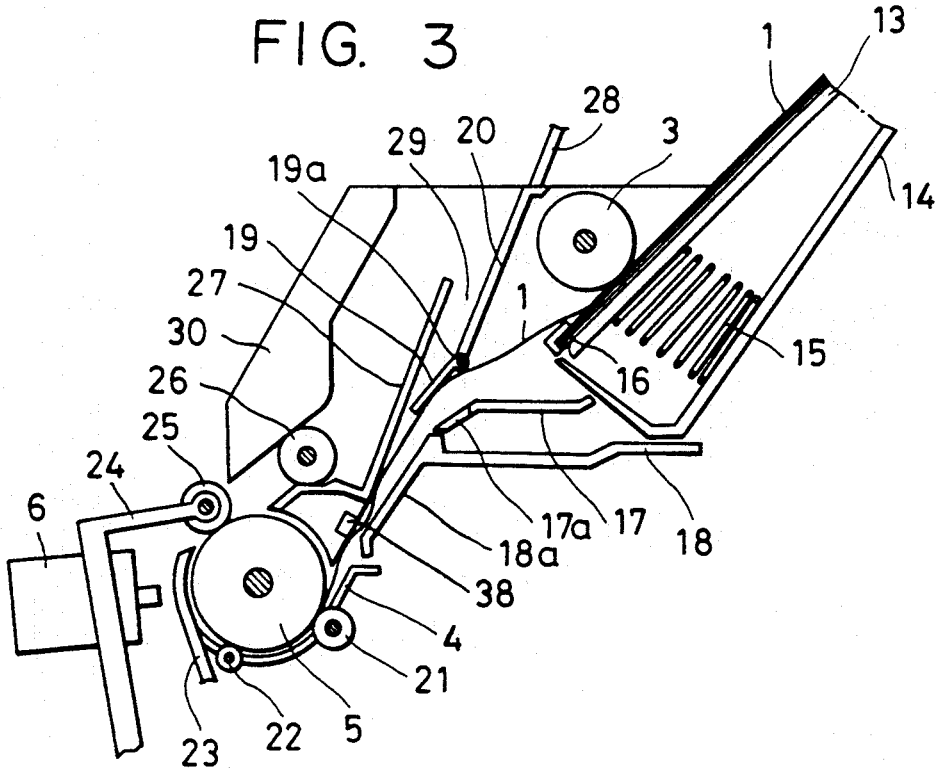
FIGS. 3 and 4 are side views showing operating states of the sheet material feeding device.
Figure 4:
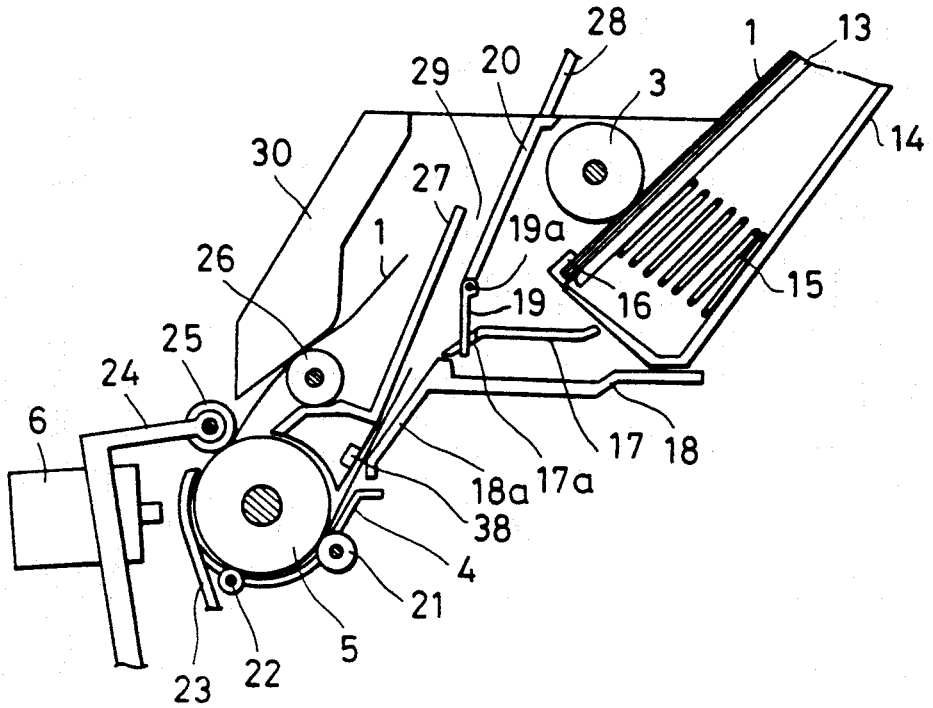

Next, the sheet material feeding device 2 will be explained with reference to FIGS. 2 through 4.

The sheet material 1 is mounted on a stack plate 13, which is a sheet material supply unit, in a stacked state, and is pressed toward the side of the feed roller 3 by a spring 15 interposed between the stack plate 13 and a chassis 14.

A separation pawl 16 for separating sheets of the sheet material 1, one by one, is provided at an outlet-side position of the stack plate 13. There is also provided a guide plate 17 forming a sheet material feeding path to feed the sheet material 1 separated by the separation pawl 16 to the side of the paper pan 4. A guide plate 18*a*, which is a part of a case 18 and which also forms part of the sheet material feeding path, is positioned between the guide plate 17 and the paper pan 4.

Furthermore, a valve member (guide) 19, which is a characteristic member in the present invention, is disposed at one end portion (a position toward the guide plate 18*a*) of the guide plate 17.

The valve member (guide) 19, which is made, for example, of hard synthetic resin, separates the space at the side of the feed roller 3 from the space at the side of a manual insertion port 29, and is swingably mounted on the lower end of a wall member 20, which serves as a guide for manual insertion, via a pin 19*a*. Usually, the valve member (guide) 19 depends nearly vertically by its own weight.

Figure 2:
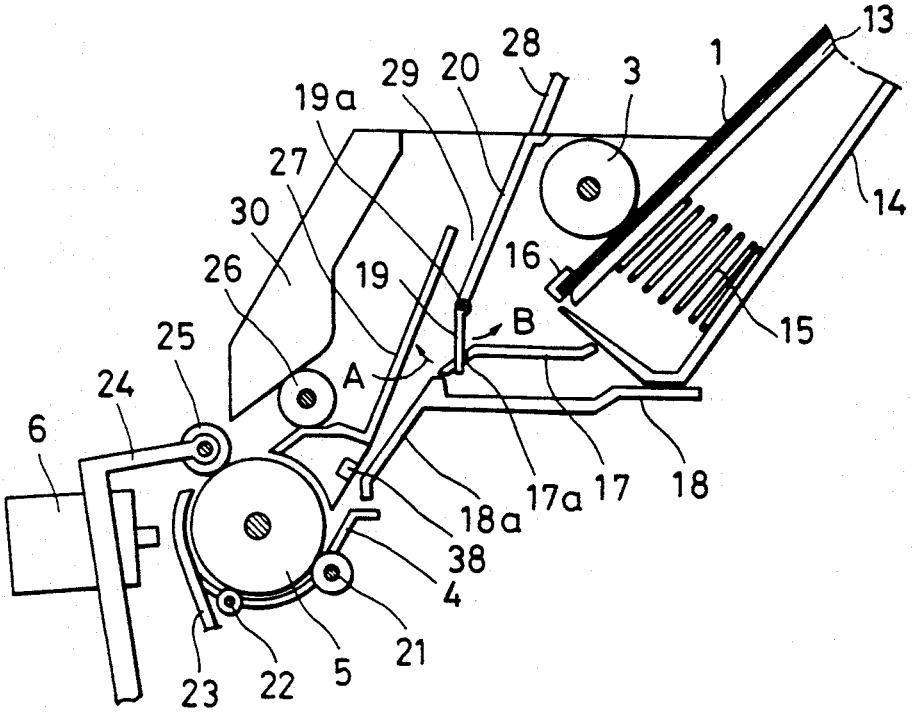
FIG. 2 is a side view of the sheet material feeding device.

The valve member (guide) 19 is opened by being rotated in the direction of arrow A shown FIG. 2 when pushed by the sheet material 1 when the sheet material 1 is fed to the side of the paper pan 4.

By its proper weight, the valve member (guide) 19 presses the front end of the sheet material 1 to the side of the platen 5 by downwardly pressing a portion of the sheet material 1 which is bent in an upwardly convex state.

A lower end portion of the valve member 19 is arranged so as not to rotate in the direction of arrow B shown in FIG. 2 by being engageable with a surface forming the bight of groove 17*a* provided in the guide plate 17, and thus prevents the sheet material 1 from returning to the side of the feed roller 3 when a printing operation is performed with reversing the sheet material 1.

In the paper pan 4, there are provided a rear feed roller 21 and a front feed roller 22 for rolling the sheet material 1 which has been fed in the platen 5.

Furthermore, around the platen 5, there are provided a card holder 23 for easily rolling the sheet material 1 fed from the paper pan 4 around the platen 5, and a bail roller 25 mounted on the free end of a bail arm 24.

The sheet material 1 rolled around the platen 5 is mounted on a stacker 27 provided above the platen 5 by a paper discharge roller 26.

There are also shown a paper stand 28 for the discharged sheet material 1, and a front cover 30.

Next, the operation of the sheet material feeding device 2 will be explained with reference to the circuit block diagram shown in FIG. 8 and the flowchart shown in FIG. 9.

When an automatic paper feeding operation is started, a motor 36 serving as a driving source for the feed roller 3 is operated by a signal from a CPU 32 in a device control unit to rotate the feed roller 3 at step S1. Only one sheet of the sheet material 1 on the stack plate 13 is separated by the separation pawl 16, and the sheet is fed toward the platen 5 via the guide plates 17 and 18*a* (see FIG. 2).

At this moment, the sheet material 1 raises and opens the valve member (guide) 19. When the front end of the sheet material 1 has been detected by a sensor 38 at step S2, the feed roller 3 feeds the sheet material 1 by a predetermined amount by being rotated by the motor 36, and is then stopped (step S3). By this feeding operation of the predetermined amount, the leading end of the sheet material 1 is stopped in contact with the platen 5 which is not driven, and is somewhat curved. The sheet material 1 is pressed by the weight of the valve member (guide) 19 so that the curved portion is flattened, the leading end of the sheet material 1 is pressed against the platen 5 by the weight of the valve member (guide) 19 and the stiffness of the sheet material 1, and the leading end is made parallel to the axis of the platen 5.

Accordingly, even when the stiffness of the sheet material 1 has changed due to temperature, humidity and the like, the sheet material 1 is inserted between the platen 5 and the paper pan 4 without inclining.

When the platen 5 then rotates by a signal from the CPU 32 at step S4, the sheet material 1 is guided by the paper pan 4 and is rolled around the platen 5.

Since the stiffness of the sheet material 1 and the weight of the valve member (guide) 19 are effective also at this moment, the sheet material 1 is fed between the platen 5 and the rear feed roller 21, and is securely rolled around the platen 5.

The platen 5 is driven by a predetermined amount until the leading end of the sheet material 1 reaches the position where it is inserted between the bail roller 25 and the platen 5, and then is stopped (steps S4, S5 and S6). Subsequently, the bail roller 25 is biased against the platen 5, with the sheet material 1 inserted between the platen 5 and the bail roller 25 (step S7).

The platen 5 is then driven, and the sheet material 1 is fed until its trailing end passes the sensor 38 (step S8 and S9). At step S10, the platen 5 is reversely rotated, and the sheet material 1 is fed in the reverse direction until the leading end of the sheet material 1 reaches the position to start recording (step S11). At the moment of commencement of the reverse rotation of the platen 5, the trailing end of the sheet material 1 will have passed through the valve member 19, and the valve member (guide) 19 will have returned to the position shown in FIG. 2 by its own weight. The trailing end of the sheet material 1 does not advance in the direction of the feed roller 3 by the reverse rotation of the platen 5, but is guided to a manual insertion port 29 by the valve member (guide) 19, and a recording operation is performed. By guiding the sheet material 1 to the manual insertion port 29, the sheet material 1 is not constrained by the feed roller 3 during the recording operation, and it is possible to achieve an exact feeding operation by the platen 5. Furthermore, when the sheet material 1 is manually fed in the reverse direction by a knob 39 shown in FIG. 1 for the purpose of correction, the sheet material 1 is not creased or broken.

In the first embodiment described above, by providing a member contacting the valve member (guide) 19 at a lower end portion of the wall member 20, it is also possible to prevent the valve member (guide) 19 from rotating in the direction of arrow B shown in FIG. 2.

Figure 5:
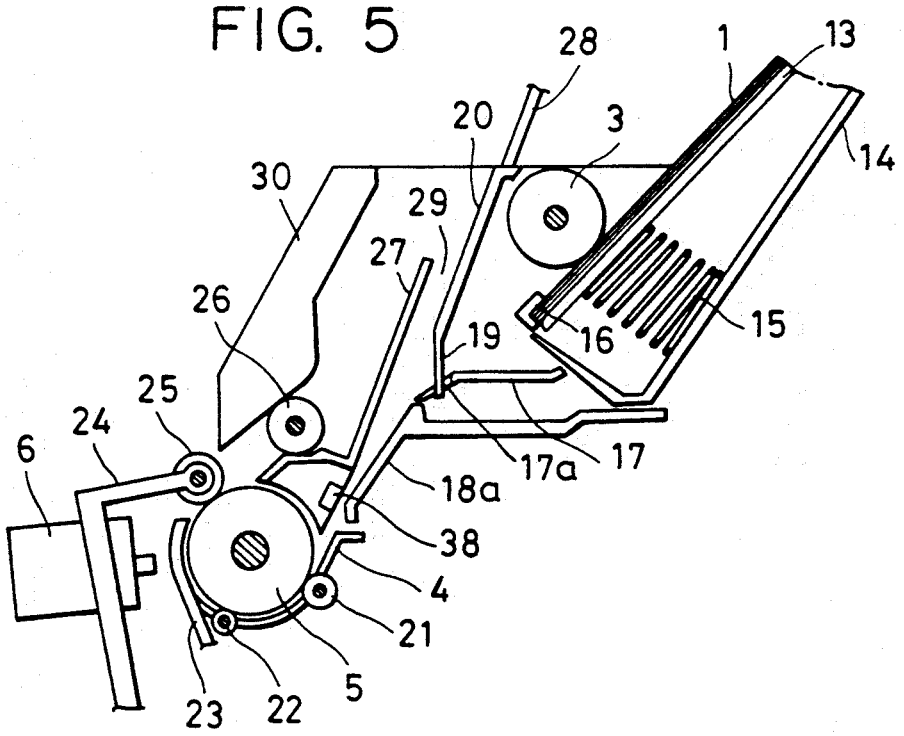
FIG. 5 is a side view showing another embodiment of a valve member.

In addition, as shown in FIG. 5, by making the lower end portion of the wall member 20 thin to provide elasticity, this portion may serve as the valve member (guide) 19.

In this case, since the valve member (guide) 19 and the wall member 20 are made as one body, it is possible to reduce the number of components, and also to reduce the number of assembling processes.

Figure 6:
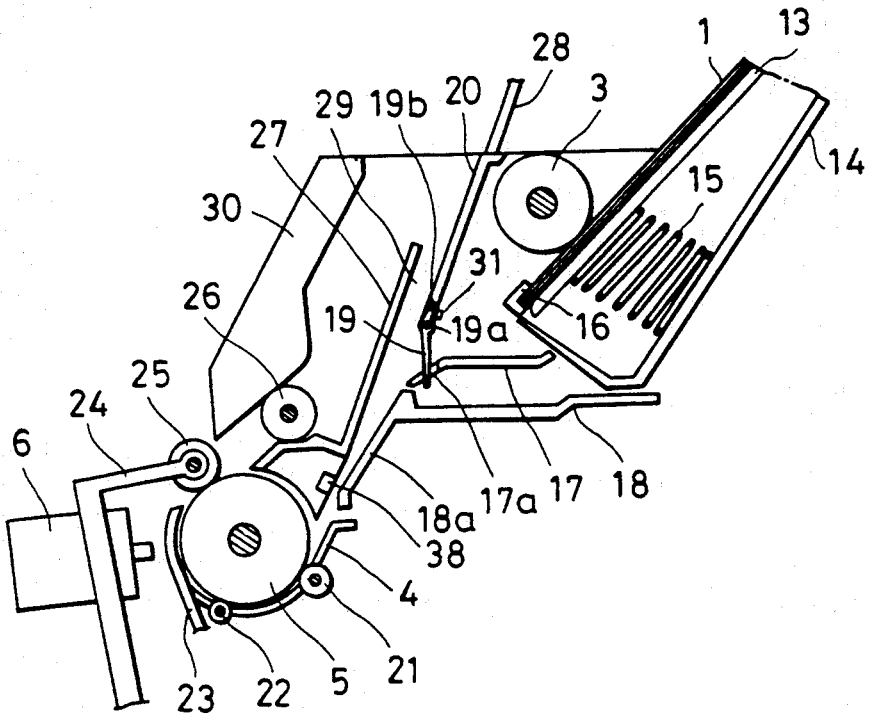
FIGS. 6 and 7 are side views showing a second embodiment of the present invention.
Figure 7:
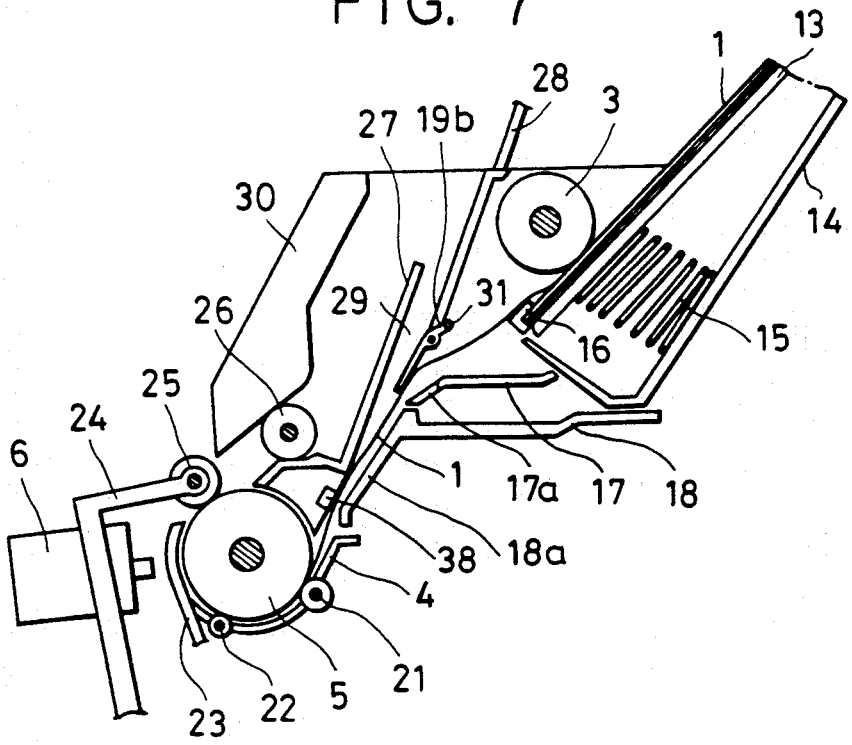

FIGS. 6 and 7 show a second embodiment of the present invention. In the second embodiment, a case is shown in which a photocoupler 31 is provided at a lower end of the wall member 20 and serves as a detection means, and a projection 19*b*, which also functions as a detection means shielding the photocoupler 31, is provided at an upper end of the valve member (guide) 19.

Figure 8:
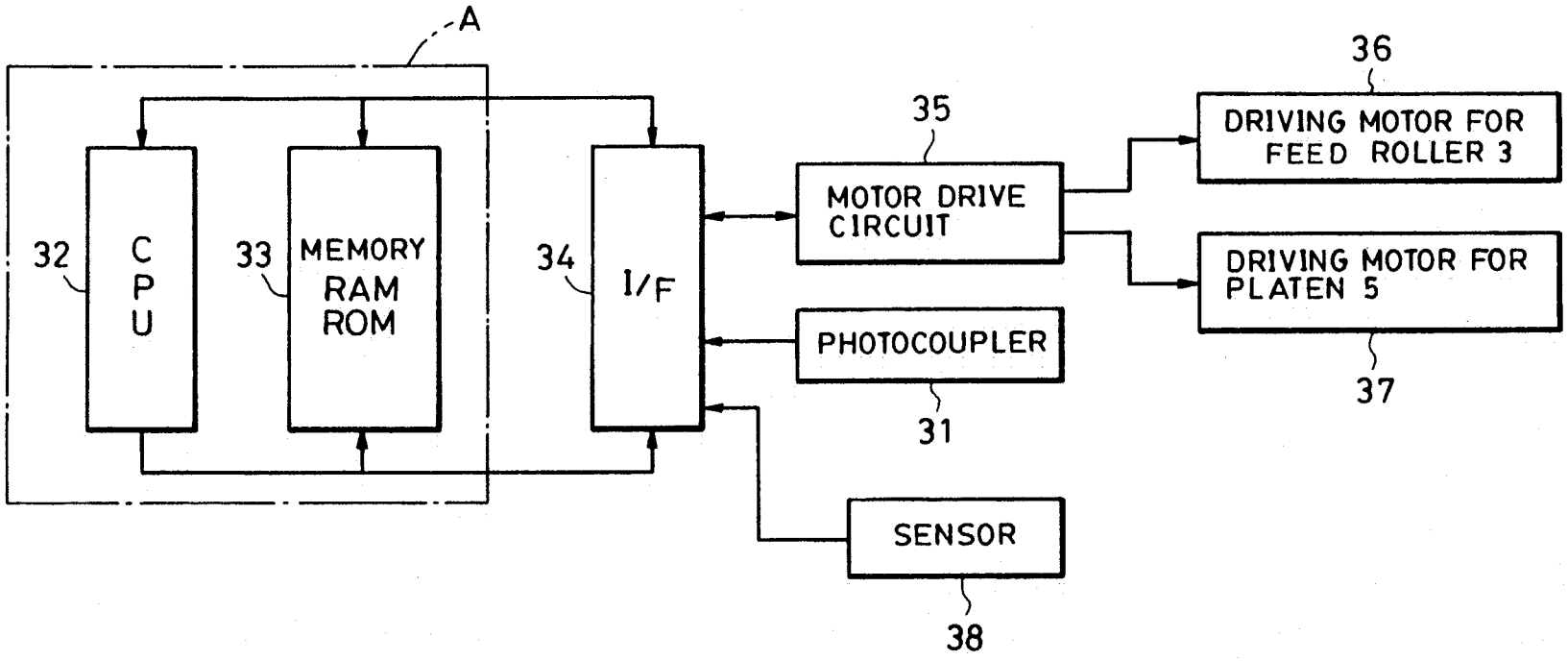
FIG. 8 is a block diagram of a control mechanism.
Figure 9:
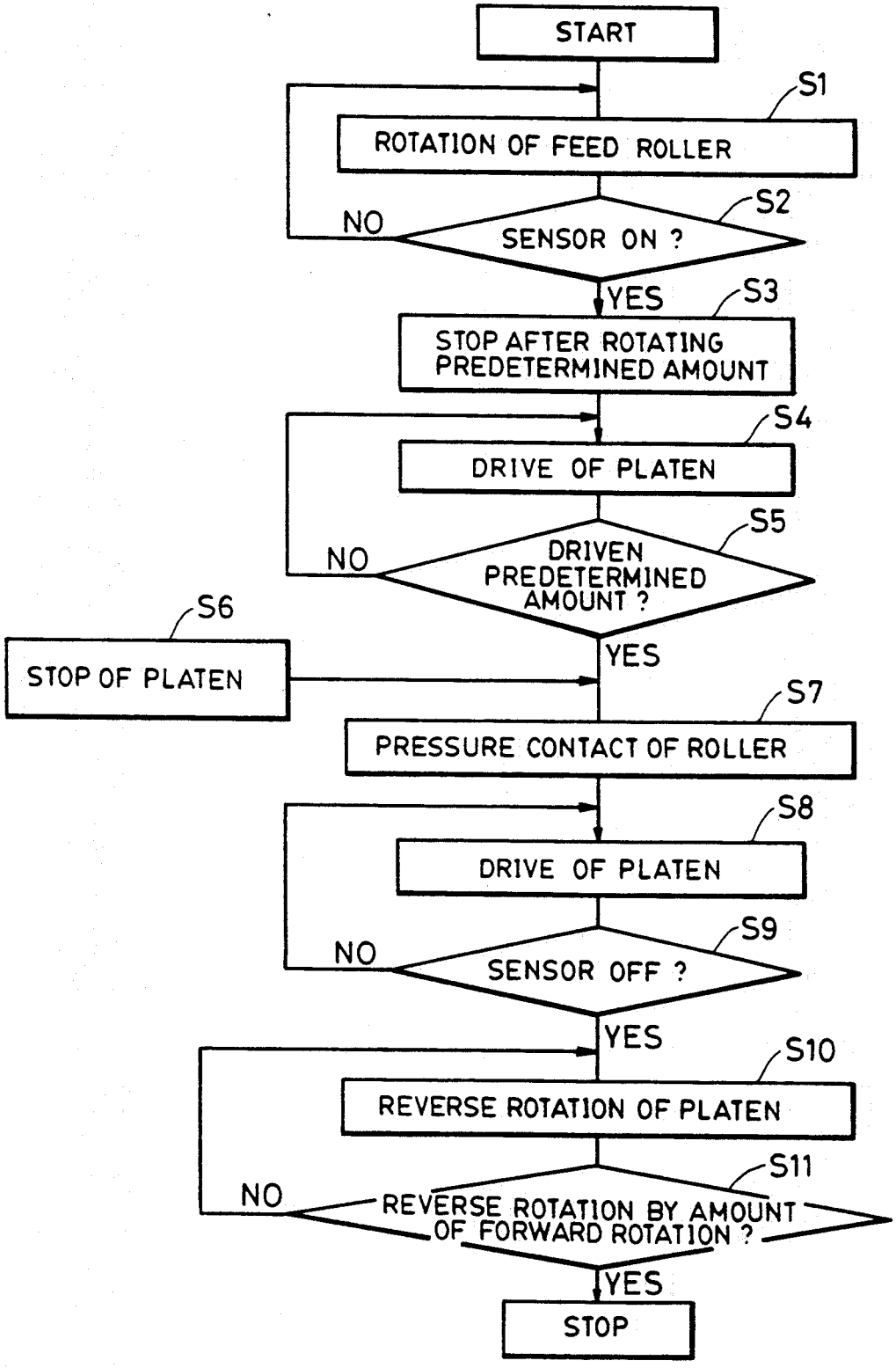
FIG. 9 is a flowchart of control in the first and second embodiments.

The photocoupler 31 is also shown in the block diagram of a control mechanism in FIG. 8. The control mechanism comprises the CPU 32 for controlling the entire system, a memory 33, such as a ROM, a RAM or the like, storing the contents of control and the like, an interface 34, a driving motor 36 for the feed roller 3, and a motor drive circuit 35 for controlling a driving motor 37 for the platen 5. When a control signal is output from the CPU 32 to the motor drive circuit 35, the driving motors 36 and 37 are operated by that circuit 35. Furthermore, a detection signal is input from the photocoupler 31 to the CPU 32 via the interface circuit 34.

Figure 11:
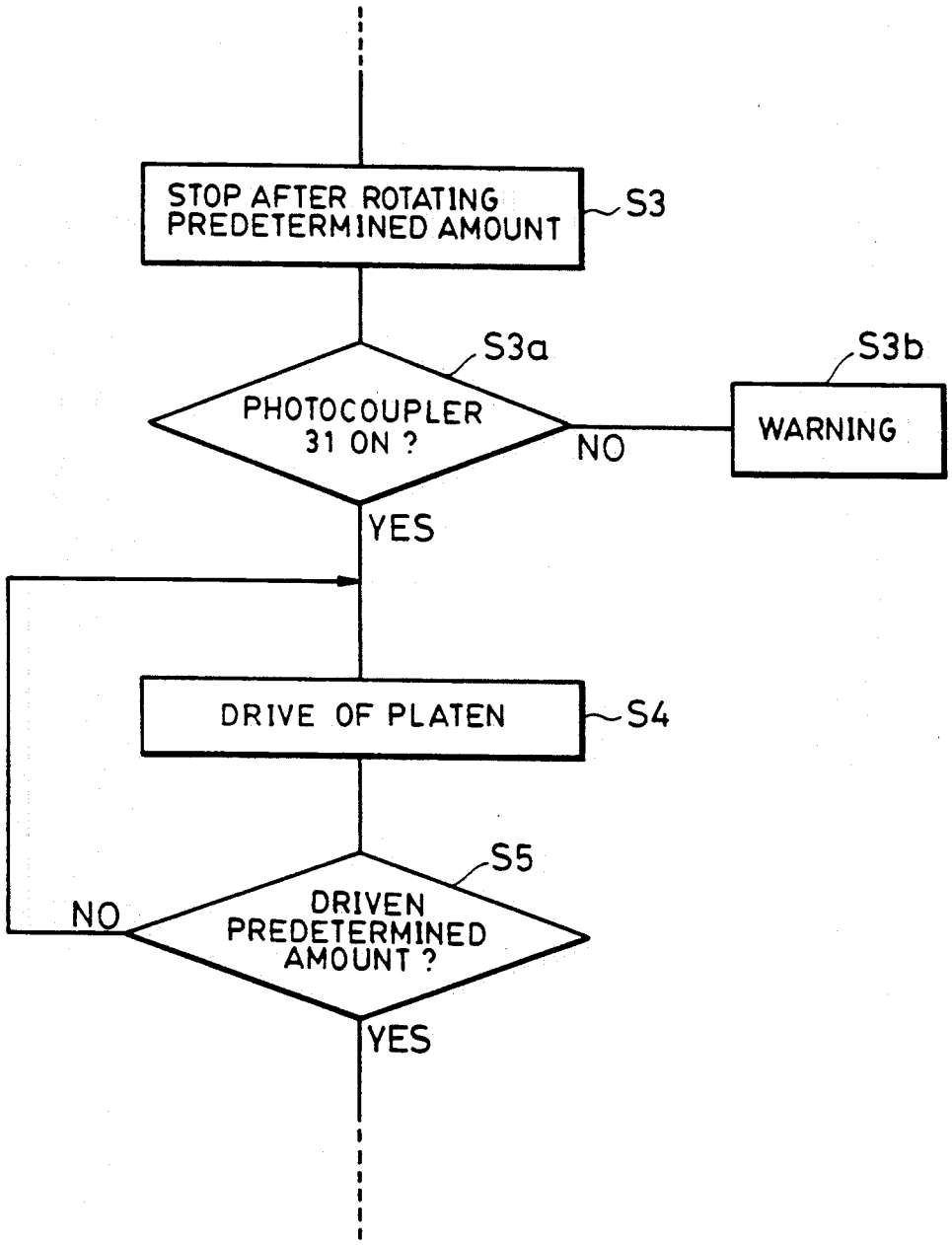
FIG. 11 is a flowchart of the second embodiment.

According to the second embodiment, as shown in the flowchart in FIG. 11, when the sheet material 1 fed by the feed roller 3 is curved by a predetermined amount while contacting the platen 5, that is, when the sheet material 1 contacts the platen 5 in a regular state, the projection 19*b* shields the photocoupler 31 (see FIG. 7). Hence, the sheet material 1 is detected by the photocoupler 31 (step S3*a*). The detection signal from the photocoupler 31 is input to the CPU 32 via the interface 34. The CPU 32 thereby reads the contents of control from the memory 33, and outputs a control signal to the motor drive circuit 35 to operate the driving motor 37 for the platen 5 (step S4).

By thus rotating the platen 5 according to the detection signal from the photocoupler 31, the sheet material 1 moves to the position to start printing in a state being securely rolled around the platen 5 without inclining.

When the sheet material 1 has not been detected by the photocoupler 31 at step S3*a*, the process proceeds to step S3*b*, where a warning of abnormality by sound or light is issued.

Since the conventional paper sensor detects only the presence of paper, the sheet material 1 is sometimes not curved by a predetermined amount even if the platen 5 is rotated according to the detection signal from the paper sensor. Accordingly, there occurs a situation in which the sheet material 1 is not rolled around the platen 5 or rolled in an inclined state because it does not regularly contacting the platen 5. Such problems may be solved by the second embodiment.

Although, in the second embodiment described above, a case has been shown in which the photocoupler 31 and the projection 19*b*, shielding the photocoupler 31, are used as detection means, the present invention is not limited to this configuration. Any detection means may be used provided that they can detect the fact that the valve member 19 is rotated.

Furthermore, the application of the sheet material feeding device according to the present embodiments is not limited to an ink-jet printer, but the device may properly be applied to a recording apparatus, such as a thermal printer, an impact printer, a laser-beam printer or the like.

Figure 10:
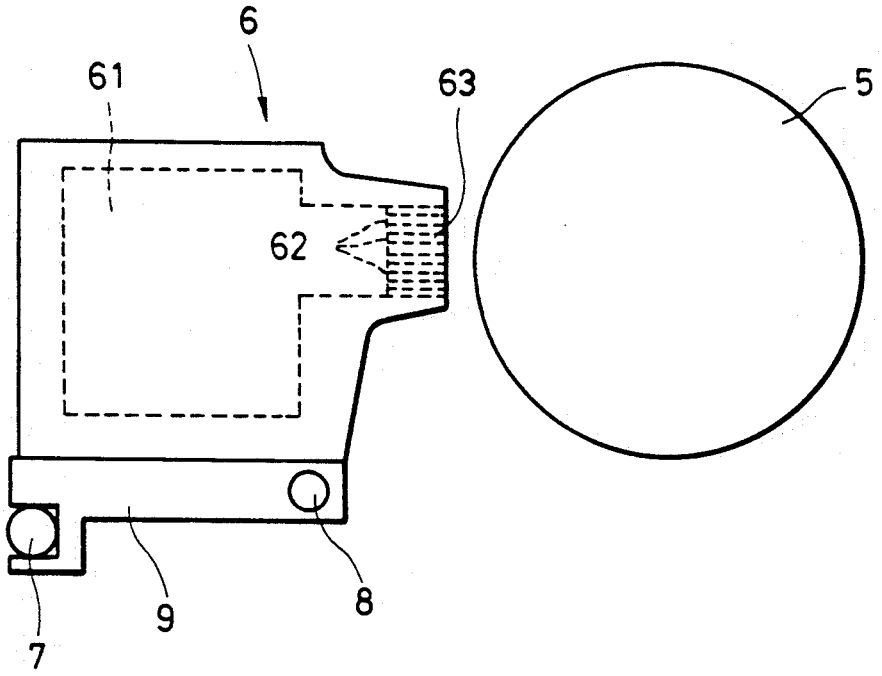
FIG. 10 is a detailed drawing of a recording head.

Next, an explanation will be provided of a recording means 6. The recording means 6 used in the present embodiments uses a serial-type bubble-jet recording method, as shown in FIGS. 1 and 10.

The carriage 9 is slidably mounted along the shafts 7 and 8 both ends of which are fixed to the main body. As shown in FIG. 1, the timing belt 10 stretched between the driving pulley 11*b* and the follower pulley 11*a* is connected to the carriage 9, and the carriage motor 12 is connected to the driving pulley 11*b*. Accordingly, when the carriage motor 12 is rotated in the forward and reverse directions, the carriage 9 reciprocates along the guide shafts 7 and 8.

Furthermore, the recording head 6 is mounted on the carriage 9. As shown in FIG. 10, the recording head 6 includes an ink reservoir 61 filled ink and a large number of liquid channels 62 aligned in a column in the vertical direction in FIG. 10.

The surface tension of the ink within each of the liquid channels 62 and the external pressure are counterbalanced with each other at the surface of each orifice in a stationary state. An electrothermal converter 63 is provided in each of the liquid channels 62. By passing an electric current corresponding to an image signal through the electrothermal converter 63, ink is discharged from the orifice to record an ink image on the sheet material 1.

That is, when a current is passed through the electrothermal converter 63, an abrupt temperature rise exceeding nucleate boiling is produced in the ink within the liquid channel 62, and the ink evaporates to produce film boiling. Air bubbles are thereby formed in the ink within the liquid channel 62. By the growth of the air bubbles, liquid drops of ink are discharged from the surface of the orifice toward the sheet material 1, and an ink image is thus recorded. When the current passing operation is terminated, the air bubbles within the liquid channel 62 are cooled by the ink and contract, and ink is supplied into the liquid channel 62 from the ink reservoir 61 by capillary action to prepare for the next current passing operation.

Accordingly, by sequentially passing a current through the corresponding electrothermal converter 63 in accordance with an image signal in synchronization with the movement of the carriage 9, an ink image is recorded on the sheet material 1.

The platen 5 for supporting the back of the sheet material 1 is provided at a position facing the orifice surfaces of the recording head 6. The sheet material 1, provided with a feeding force by the rotation of the platen 5, is fed between the recording head 6 and the platen 5. Since the sheet material 1 is arranged so as not to be detached from the surface of the platen 5 by the bail roller 25, the back of the sheet material 1 is not detached from the platen 5, and the space between the orifice surfaces and the sheet material 1 is always maintained constant.

What is claimed is:

1. A sheet material feeding device comprising:

a first conveying path for guiding a sheet material;

a second conveying path for guiding the sheet material and which joins said first conveying path;

stop means for stopping the leading end of the sheet material fed through said first conveying path and bending the sheet material; and a guide member provided at the joining point of said first conveying path and said second conveying path, for allowing the sheet material fed from an upstream side through said first conveying path to pass said joining point, and for preventing the sheet material fed from a downstream side through said first conveying path from entering an upstream side of said joining point;

said guide member pressing a curved portion of the sheet material fed through said first conveying path and stopped by said stop means in a direction to flatten said portion.

2. A sheet material feeding device according to claim 1, further including feeding means for feeding the sheet material through the first conveying path.

3. A sheet material feeding device according to claim 2, further including mounting means for mounting the sheet material, and wherein said feeding means feeds the sheet material mounted on said mounting means.

4. A sheet material feeding device according to claim 1, wherein said stop means includes a pair of rotating members rotatably contacting each other.

5. A sheet material feeding device according to claim 1, wherein said guide member is mounted for pivoted movement.

6. A sheet material feeding device according to claim 5, wherein said guide member is situated at a position to close said joining point in said first conveying path by the guide member's own weight.

7. A sheet material feeding device according to claim 6, wherein said guide member is pivoted by the sheet material fed through the first conveying path to allow the sheet material to pass said joining point in the first conveying path.

8. A sheet material feeding device according to claim 7, wherein said guide member presses the curved portion of the sheet material in a direction to flatten it by the guide member's own weight.

9. A sheet material feeding device according to claim 1, further including conveying means situated farther downstream than said joining point in said first conveying path, for conveying the sheet material fed through the first conveying path to a downstream side until the sheet material passes said joining point, and for subsequently conveying the sheet material to an upstream side.

10. A sheet material feeding device according to claim 9, wherein said guide member guides the sheet material conveyed through said first conveying path toward an upstream side by said conveying means to said second conveying path.

11. A sheet material feeding device comprising:

a first conveying path for guiding a sheet material;

a second conveying path for guiding the sheet material and which joins said first conveying path;

mounting means for mounting the sheet material;

feeding means for feeding the sheet material mounted on said mounting means to said first conveying path;

a pair of rotating members for grasping and conveying the sheet material fed through said first conveying path; and a guide member provided at the joining point of said first conveying path and said second conveying path, for allowing the sheet material fed from an upstream side through said first conveying path to enter a downstream side of said joining point, and for preventing the sheet material conveyed from a downstream side toward an upstream side through said first conveying path by said pair of rotating members from entering an upstream side of said joining point;

said guide member pressing a curved portion of the sheet material fed through said first conveying path and stopped by said pair of rotating members in a direction to flatten said portion.

12. A sheet material feeding device according to claim 11, wherein said guide member is mounted for pivoted movement.

13. A sheet material feeding device according to claim 12, wherein said guide member is situated at a position to close said joining point in said first conveying path by the guide member's own weight.

14. A sheet material feeding device according to claim 13, wherein said guide member is pivoted by the sheet material fed through the first conveying path to allow the sheet material to pass through said joining point in the first conveying path.

15. A sheet material feeding device according to claim 14, wherein said guide member presses the curved portion of the sheet material in a direction to flatten it by the guide member's own weight.

16. A sheet material feeding device according to claim 12, further including detection means for detecting a pivoted movement of said guide member.

17. A sheet material feeding device comprising:

a first conveying path for guiding a sheet material;

a second conveying path for guiding the sheet material and which joins said first conveying path;

mounting means for mounting the sheet material;

feeding means for feeding the sheet material mounted on said mounting means to said first conveying path;

a pair of rotating members for grasping and conveying the sheet material fed through said first conveying path;

a guide member provided at the joining point of said first conveying path and said second conveying path, for allowing the sheet material fed from an upstream side through said first conveying path to enter a downstream side of said joining point, and for preventing the sheet material conveyed from a downstream side toward an upstream side through said first conveying path by said pair of rotating members from entering an upstream side of said joining point;

control means for controlling said pair of rotating members so that said pair of rotating members are held in an inactive state to stop the front end of the sheet material fed through said first conveying path, and to bend the sheet material and then rotated to convey the sheet material until the trailing end of the sheet material passes said joining point, and are subseqently rotated in the reverse direction by a predetermined amount; and said guide member pressing a curved portion of the sheet material fed through said first conveying path and stopped by said pair of rotating members in a direction to flatten said portion.

18. A sheet material feeding device comprising:

a first conveying path for guiding a sheet material;

a second conveying path for guiding the sheet material and which joins said first conveying path;

mounting means for mounting the sheet material;

feeding means for feeding the sheet material mounted on said mounting means to said first conveying path;

a pair of rotating members for grasping and conveying the sheet material fed through said first conveying path;

recording means for recording an image on the sheet material conveyed by said pair of rotating members;

a guide member provided at the joining point of said first conveying path and said second conveying path, for allowing the sheet material fed from an upstream side through said first conveying path to enter a downstream side of said joining point, and for preventing the sheet material conveyed from a downstream side toward an upstream side through said first conveying path by said pair of rotating members from entering an upstream side of said joining point; and said guide member pressing a curved portion of the sheet material fed through said first conveying path and stopped by said pair of rotating members in a direction to flatten said portion.

19. A sheet material feeding device according to claim 18, wherein said recording means records the image by liquid drops of ink generated by thermal energy.

* * * * *

UNITED STATES PATENT AND TRADEMARK OFFICE

CERTIFICATE OF CORRECTION

PATENT NO. 5,171,006

DATED December 15, 1992

INVENTOR(S) Hisatsugu NAITO

It is certified that error appears in the above-indentified patent and that said Letters Patent is hereby corrected as shown below:

COLUMN 2

Line 16, "be" should read --by--.

COLUMN 6

Line 12, "filled ink" should read --filled with ink--.

Signed and Sealed this

Eleventh Day of January, 1994

Bruce Lehman

*Attest:*

BRUCE LEHMAN

*Attesting Officer*

*Commissioner of Patents and Trademarks*